United States Patent [19]

Murphy et al.

[11] 4,331,840

[45] May 25, 1982

[54] ELECTRET TRANSDUCER WITH TAPERED ACOUSTIC CHAMBER

[75] Inventors: Preston V. Murphy; Kurt Hübschi, both of Geneva, Switzerland

[73] Assignee: Lectret S.A., Geneva, Switzerland

[21] Appl. No.: 123,718

[22] Filed: Feb. 22, 1980

[51] Int. Cl.[3] ..... H04R 19/04

[52] U.S. Cl. ..... 179/111 E

[58] Field of Search ..... 179/111 R, 111 E

[56] References Cited

U.S. PATENT DOCUMENTS

| | | | |
|---|---|---|---|
| Re. 28,420 | 5/1975 | Murphy | 179/111 E |
| 3,108,162 | 10/1963 | Schindler | 179/111 R |
| 3,436,492 | 4/1969 | Reedyk | 179/111 |
| 3,772,133 | 11/1973 | Schmitt | 161/112 |
| 3,833,770 | 9/1974 | Atoji et al. | 179/111 E |
| 3,894,198 | 7/1975 | Murayama et al. | 179/111 E |
| 3,963,881 | 6/1976 | Fraim et al. | 179/111 E |
| 4,142,073 | 2/1979 | Agneus et al. | 179/111 E |
| 4,160,881 | 7/1979 | Smulders | 179/111 E |
| 4,225,755 | 9/1980 | Block | 179/111 E |
| 4,236,051 | 11/1980 | Nakagawa et al. | 179/111 E |

FOREIGN PATENT DOCUMENTS

| | | | |
|---|---|---|---|
| 825997 | 11/1951 | Fed. Rep. of Germany | 179/111 |
| 2200150 | 1/1977 | Fed. Rep. of Germany . | |

*Primary Examiner*—George G. Stellar

[57] ABSTRACT

An electret transducer wherein a backplate is mounted between inwardly disposed surfaces of a ridge protruding from a face of a frame, a diaphragm is mounted on the ridge, and an acoustic chamber, which is partially defined by the diaphragm, diminishes in size as it becomes more remote from an opening to it.

1 Claim, 7 Drawing Figures

FIG 6
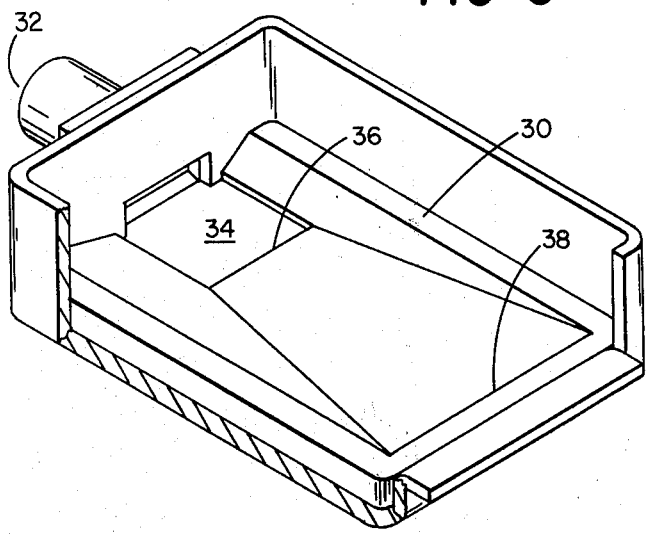
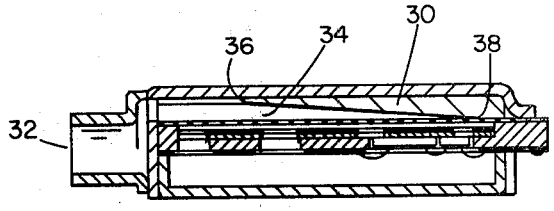
FIG 7

ELECTRET TRANSDUCER WITH TAPERED ACOUSTIC CHAMBER

FIELD OF THE INVENTION

This invention relates to electret transducers.

BACKGROUND OF THE INVENTION

Such transducers are already known.

One known electret transducer is equipped with a diaphragm electrode and a flat, counter polarity carrying, perforated backplate. The latter forms on the side, facing the diaphragm, precisely placed supporting protrusions on which the diaphragm rests and is mounted on its circumference.

An electret transducer is disclosed in Murphy U.S. Pat. No. Re. 28,420, "Electret Acoustic Transducer", issued May 13, 1975.

In Griese German Pat. No. 2,200,150, granted Jan. 13, 1977, an acoustic chamber diminishing in height as it becomes more remote from a side-entering sound signal is disclosed.

SUMMARY OF THE INVENTION

The invention aims to design a transducer as simply as possible with special emphasis on constructive components and elements to aid in the proper positioning and assembling without additional gauging aids, particularly in view of the fact that the parts of such transducers are at best extremely small and their manipulation represents difficult problems. Therefore, the design concept of the invention is to produce constructive instrument components enabling a proper and functional assembly with only a minimum of additional aids.

In accordance with the above, this is achieved by having a carrying frame with a mounting surface for the backplate being surrounded, preferably for the entire circumference, with an elevated edge. On this edge sits the mounted diaphragm (i.e. adhered on) and the backplate rests in the cavity built up by the surrounding edge. The inside contour of this edge corresponds exactly with the outer perimeter of the backplate, which is mounted flush on the mounting surface of the cavity in the carrying frame. Following this design philosophy results in a fully levelled diaphragm with accurate positioning to the backplate, which is nestled in the carrying frame. Since the outer perimeter of the backplate corresponds exactly to the inside contour of the elevated edge of the carrying frame, the backplate fits without any play into the cavity of this frame. This guarantees absolute correct positioning of the three parts: diaphragm, backplate and carrying frame. Furthermore, tbe level, horizontal positioning of the backplate on the frame achieves, within limits, a reduced height of the transducer. In addition, this arranges, by simple constructive means, that the critical distance between the two electrodes is maintained without any problems and further insures against no other handicapping acoustic chambers. Since the distance between diaphragm and backplate amounts to approximately 40/1000 of a millimeter, one can really appreciate the advantages of the transducer constructed in accordance with the present invention.

A further significant aspect, in accordance with the invention, is represented by an etched or printed circuit on the bottom side of the carrying frame, opposite the side forming the elevated edge, which facilitates the electrical connections for the operation of the transducer. In this way the carrying frame fulfills not only mechanical but also other functional assignments within the system. In view of the high resistance values found in these transducers, an impedance changing circuit is required in close proximity, and this calls for wiring connections for which, in the case at hand, this printed circuit can be utilized. As a point of fact, this necessitates, preferably, an integrated amplifying circuit mounted on the bottom side of the backplate (i.e. adhered on), which is then, spacewise, accommodated by a cut-out in the carrying frame.

To provide for external connections for the circuits of the internal system, it is further desirable to extend the carrying frame to an enlarged section adjacent to the mounting edge of the diaphragm; this is done preferably on one of its smaller sides. This section, when assembled in the casing, should be at least partially placed into a slit-formed cutout of the casing. By way of this mounting the connection points of the transducer can be approached from the outside. It is a further point, according to the invention, that the printed circuit is arranged on the enlarged section of the carrying frame and enclosed edge-wise by one of the two casings, that carries an electrically conductive edge surface, and thus represents an externally exposed power potential. All these advantages, inherent in the invention, develop by themselves during correct step by step assembly of the components without any additional manipulation.

Another aspect, a most preferred embodiment of the invention, shown in FIG. 6, provides a novel acoustic terminal, in which the acoustic chamber adjacent the diaphragm is diminished in size as it becomes more remote from the opening to it.

PREFERRED EMBODIMENTS

We turn now to description of the structure and operation of preferred embodiments of the invention, after first briefly describing the drawings.

DRAWINGS

FIG. 6 is an isometric view, partially broken away, of the spacer of the most preferred embodiment of the invention; and FIG. 7 is a sectional view of said most preferred embodiment of the invention, the spacer of FIG. 6 being assembled in position upside down from that shown in FIG. 6.

STRUCTURE

Figure 1:
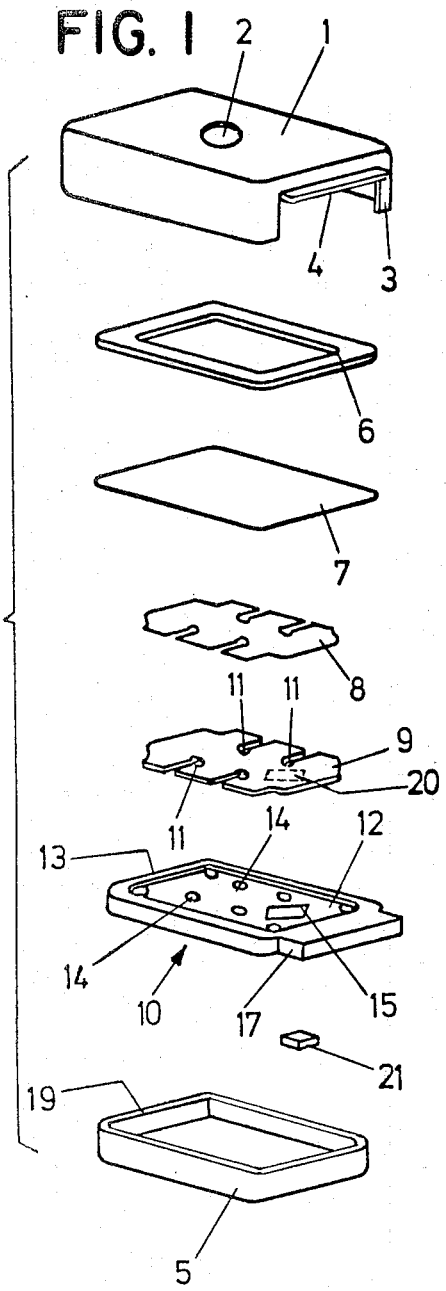
FIG. 1 is an exploded isometric view of all single components of the transducer in a vertical array.
Figure 2:
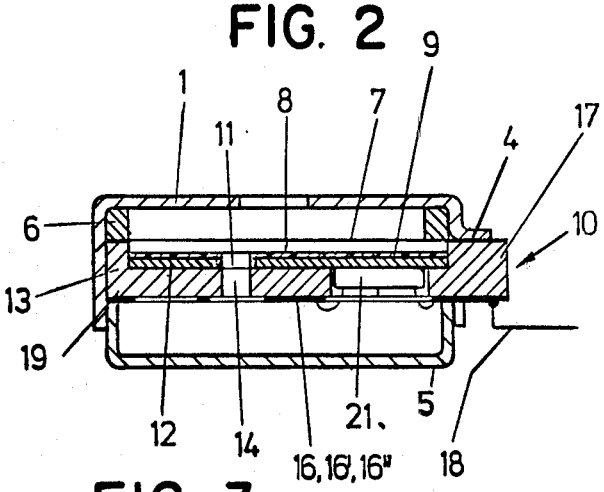
FIG. 2 is a view of a cross-section of the assembled transducer, taken at II—II of FIG. 3.

In FIGS. 1 and 2 the upper casing 1 of the transducer carries an acoustical reception passage 2. This casing 1 is formed like a lid of a box. On its small side 3 are two separated but parallel cuts which form a cut-out with an overhanging flange 4. The lower and second casing 5 is also formed like a box, yet its surrounding walls are continuous. The parts placed between these casings 1 and 5 are: distance spacer 6, diaphragm 7, the dielectrical material layer 8 (electret) and the affixed metallic conductive plate 9, which comprise the integrated backplate 8, 9, and the carrying frame 10 with an integrated amplifying circuit 21. The foil 8 of dielectrical material and the metallic conductive plate 9 are solidly joined to form the backplate 8, 9. The dielectrical foil on the plate 9 also extends onto the wall sections of the cut-outs 11, as shown in the cross cut drawing, illustrated by FIG. 2.

The carrying frame 10 is constructed from electrically non-conductive, insulating material. It forms the mounting surface 12 for the backplate 8, 9 and is completely surrounded by an elevated edge 13 with a flat mounting surface for the membrane 7. Frame 10 with edge 13 can be one piece, but they could also be made as separate pieces; i.e., the carrying plate and a seamless frame to form the edge 13.

Figure 3:
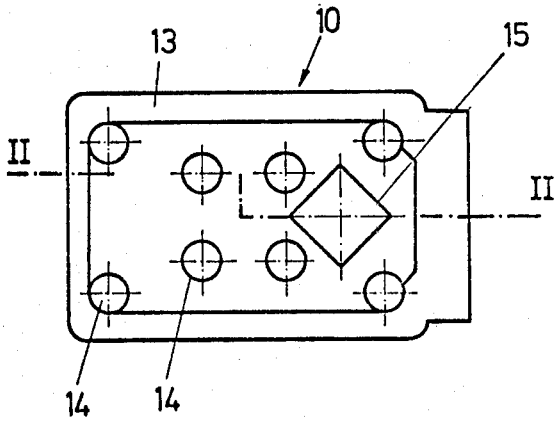
FIG. 3 is a top view of the carrying frame.
Figure 4:
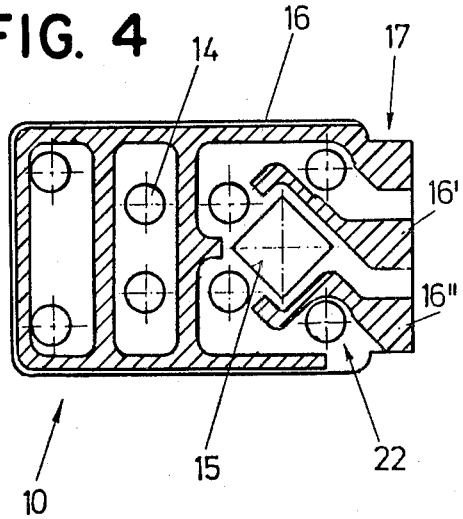
FIG. 4 is a bottom view of the same (both drawings are enlarged in scale by comparison with FIG. 1)

There are several apertures and cut-outs situated in the mounting surface 12 of the carrying frame 10 as shown in FIG. 3 which are matched with the ones in the backplate 8, 9 (FIG. 2). There is in addition to that a further cut-out 15 in the frame 10. This frame also carries on its bottom side conductors 16, 16', 16'' of a printed circuit (FIG. 4). One of these conductors 16 pursues the rim of the carrying frame 10. The above-mentioned conductors of the printed circuit 16, 16', 16'' terminate on an enlarged section 17, forming the small side of the elevated edge 13, being the mounting of diaphragm 7. This section 17 protrudes from the casing 1 and 5 of the transducer by allowing herewith the carrying frame 10 to expose connection facilities 18 (FIG. 2) for external wirings. The rim of frame 10 is in contact with the edge 19 of the bottom casing 5. The body of this casing 5 consists of electrically conductive material resulting in a conductive connection between conductor 16 and the casing.

The edge 13 of the carrying frame 10 forms a cavity, which accommodates the backplate 8, 9. To assure a flat mounting of the backplate 8, 9 onto this mounting surface 12, the bottom side of this plate is purposely ground even prior to installation. The sizes of the cavity and that of the backplate 8, 9 are matched in their contours of their respective circumferences to assure a tight fit without play or horizontal shift of these parts. There is a friction contact between the backplate 8, 9 and the inside wall of the cavity, forming the edge 13. The backplate is adhered to the mounting surface 12 of the carrying frame.

The diaphragm 7 is cemented to the flat upper surface of the edge 13 and tightened to become a vibrating membrane. By this process a fixed distance between diaphragm 7 and backplate 8, 9 is also achieved. As per FIG. 2, the spacer 6 serves only as a positioning aid during assembly. The two casing parts are adhered to each other.

Figure 5:
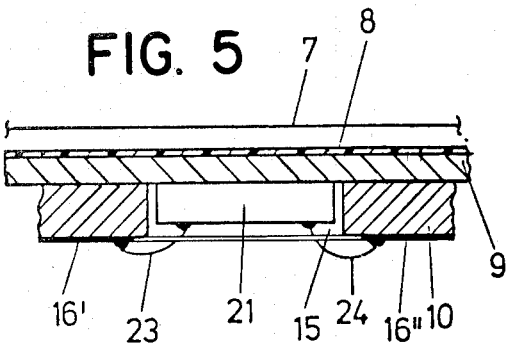
FIG. 5 shows an enlarged and detailed section corresponding to a portion of FIG. 2 including the integrated circuit.

The dotted line 20 in FIG. 1 shows the location of the integrated amplifying circuit on the bottom side of the backplate 8, 9. This has to be an impedance changing circuit required by the high resistance of the transducer. After assembly, the backplate 8, 9 rests flush upon the mounting surface 12 of the frame 10 and the said amplifier 21 protrudes into the cut-out 15 of the same. As shown in FIG. 5 the input of the amplifier 21 is connected to the conductors 16, 16', 16'' by way of the leads 23 and 24. The enlarged section 17 of the frame 10 protrudes from the side of the casings 1 and 5; here terminate the conductors 16, 16', 16'' of the printed circuit and are available for external wiring leads.

In the most preferred embodiment, shown in FIG. 7, the assembly is the same as that previously described, with two exceptions. First, the acoustic terminator, indicated generally at 30, and best shown in FIG. 6, is substituted for the spacer 6. (The acoustic terminator is shown in FIG. 6, for clarity, in a position upside down from that in which it is assembled in FIG. 7.) Secondly, sound is introduced through side entrance conduit 32 rather than through a top opening 2. As most clearly shown in FIG. 6, the acoustic terminator 30, which defines with diaphragm 7 the acoustic chamber, includes taper 34, which begins at edge 36 spaced about one-fourth of the length of the chamber from one transverse edge of diaphragm 7, so that the height of the chamber diminishes continuously toward the other end 38 of the taper, where the height of the chamber is 0.

As the height of the chamber defined by taper 34 and diaphragm 7 diminishes, its width is simultaneously increasing from edge 36 to edge 38. Both the change in the height of the said chamber as mentioned and the change in its width as mentioned provide less attenuation by the input through passage 32 of the higher acoustic frequencies.

What is claimed is:

1. A electret transducer comprising a backplate coated on one face with a dielectric material, a diaphragm spaced apart from and positioned parallel to said backplate and facing said one face, a frame for carrying said backplate and said diaphragm, and means for defining an acoustic chamber, said means including said diaphragm and a member having an inner surface spaced from and opposing said diaphragm, said chamber having an opening thereto located at a chamber boundary non-parallel with said diaphragm and located near one side edge of said diaphragm, the height of said chamber defined by said inner surface and said diaphragm diminshing substantially continuously from near said opening to zero height at an opposite side of said diaphragm, the average width of said inner surface increasing substantially continuously from near said opening to said opposite side.

* * * * *